US012338838B2

(12) United States Patent
Tsuzuki et al.

(10) Patent No.: US 12,338,838 B2
(45) Date of Patent: Jun. 24, 2025

(54) MOUNTING STRUCTURE FOR COMPRESSOR AND COMPRESSOR

(71) Applicant: KABUSHIKI KAISHA TOYOTA JIDOSHOKKI, Kariya (JP)

(72) Inventors: Masafumi Tsuzuki, Kariya (JP); Satoshi Koumura, Kariya (JP); Satoru Egawa, Kariya (JP); Hironao Yokoi, Kariya (JP); Kenta Owaki, Kariya (JP); Naofumi Kimura, Kariya (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 0 days.

(21) Appl. No.: 18/674,413

(22) Filed: May 24, 2024

(65) Prior Publication Data

US 2024/0418184 A1 Dec. 19, 2024

(30) Foreign Application Priority Data

Jun. 15, 2023 (JP) ..... 2023-098675

(51) Int. Cl.
*F04D 29/66* (2006.01)
*F04D 17/10* (2006.01)
(Continued)

(52) U.S. Cl.
CPC ..... *F04D 29/668* (2013.01); *F04D 17/10* (2013.01); *F04D 29/057* (2013.01); *F04D 29/601* (2013.01)

(58) Field of Classification Search
None
See application file for complete search history.

(56) References Cited

U.S. PATENT DOCUMENTS 2,270,335 A * 1/1942 Parkinson ..... F16F 3/10 267/140.2
6,352,247 B1 3/2002 Ishikawa et al.
(Continued)

FOREIGN PATENT DOCUMENTS

JP H10-205447 A 8/1998
JP 2000-234586 A 8/2000
(Continued)

OTHER PUBLICATIONS

Ishikawa et al—JP 2000234586 A + machine translation (Year: 2000).*

(Continued)

*Primary Examiner* — Juan G Flores
(74) *Attorney, Agent, or Firm* — Sughrue Mion, PLLC

(57) ABSTRACT

A mounting structure for mounting a compressor to a mounting surface of a vehicle is disclosed. The compressor includes a rotating body that includes a rotary shaft and a compression mechanism. The compression mechanism is provided at least at one end of the rotary shaft in an axial direction. The compressor includes a radial bearing that supports the rotary shaft, a thrust bearing that supports the rotary shaft, and a housing that accommodates the rotating body, the radial bearing, and the thrust bearing. The radial bearing and the thrust bearing are gas bearings. The mounting structure includes a mounting foot that is made from an elastic member and fixed to the housing and the mounting surface. The resonance frequency of the mounting foot is lower than the resonance frequency of the radial bearing and lower than the resonance frequency of the thrust bearing.

4 Claims, 2 Drawing Sheets

(51) Int. Cl.
*F04D 29/057* (2006.01)
*F04D 29/60* (2006.01)

(56) References Cited

U.S. PATENT DOCUMENTS

| | | | | |
|---|---|---|---|---|
| 9,435,339 | B2 * | 9/2016 | Calhoun | F04C 29/066 |
| 11,002,287 | B2 * | 5/2021 | Ahn | F04D 29/5806 |
| 2014/0271242 | A1 * | 9/2014 | Calhoun | F04C 15/0057 417/363 |
| 2021/0364059 | A1 * | 11/2021 | Hayashi | F16F 15/08 |

FOREIGN PATENT DOCUMENTS

| | | | |
|---|---|---|---|
| JP | 2010-156280 | A | 7/2010 |
| JP | 2014-177935 | A1 | 9/2014 |
| JP | 2017-044313 | A | 3/2017 |

OTHER PUBLICATIONS

Hayashi et al—JP 2017044313 A + machine translation (Year: 2017).*

* cited by examiner

MOUNTING STRUCTURE FOR COMPRESSOR AND COMPRESSOR

CROSS-REFERENCE TO RELATED APPLICATIONS

This application is based upon and claims the benefit of priority from prior Japanese Patent Application No. 2023-098675, filed on Jun. 15, 2023, the entire contents of which are incorporated herein by reference.

BACKGROUND

1. Field

The present disclosure relates to a mounting structure for a compressor, and to a compressor.

2. Description of Related Art

Japanese Laid-Open Patent Publication No. 2017-44313 discloses a mounting structure for mounting a compressor on a mounting surface of a vehicle. The compressor includes, for example, a rotating body, bearings, and a housing. The rotating body includes, for example, a rotary shaft and a compression mechanism. The compression mechanism is provided at least at one end of the rotary shaft in the axial direction and rotates with the rotary shaft so as to compress a fluid. The bearings include, for example, a radial bearing that rotatably supports the rotary shaft in a radial direction and a thrust bearing that rotatably supports the rotary shaft in a thrust direction. The housing accommodates, for example, the rotating body, the radial bearing, and the thrust bearing. The mounting structure of the above publication includes mounting feet. The mounting feet are fixed to, for example, the housing of the compressor and the mounting surface of the vehicle.

As the vehicle vibrates, vibration from the vehicle can be transmitted to the compressor, causing the compressor to vibrate. If the compression mechanism vibrates greatly, the components of the compression mechanism may collide with each other, which is undesirable. Therefore, there has been a desire to suppress vibrations of the compression mechanism that occur due to vibration of the vehicle.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a mounting structure for mounting a compressor on a mounting surface of a vehicle is provided. The compressor includes a rotating body, a radial bearing, a thrust bearing, and a housing. The rotating body includes a rotary shaft and a compression mechanism. The compression mechanism is provided at least at one end of the rotary shaft in an axial direction and configured to rotate with the rotary shaft so as to compress a fluid. The radial bearing rotatably supports the rotary shaft in a radial direction. The thrust bearing rotatably supports the rotary shaft in a thrust direction. The housing accommodates the rotating body, the radial bearing, and the thrust bearing. The radial bearing and the thrust bearing are gas bearings. The mounting structure comprises a mounting foot that is made from an elastic member and fixed to the housing and the mounting surface. A resonance frequency of the mounting foot is lower than a resonance frequency of the radial bearing and lower than a resonance frequency of the thrust bearing.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

In this specification, "at least one of A and B" should be understood to mean "only A, only B, or both A and B."

An embodiment of the present disclosure will now be described with reference to the drawings. A compressor 10 of the present embodiment is a motor-driven compressor. The compressor 10 of the present embodiment is used, for example, in a vehicle air conditioner.

Compressor

Figure 1:
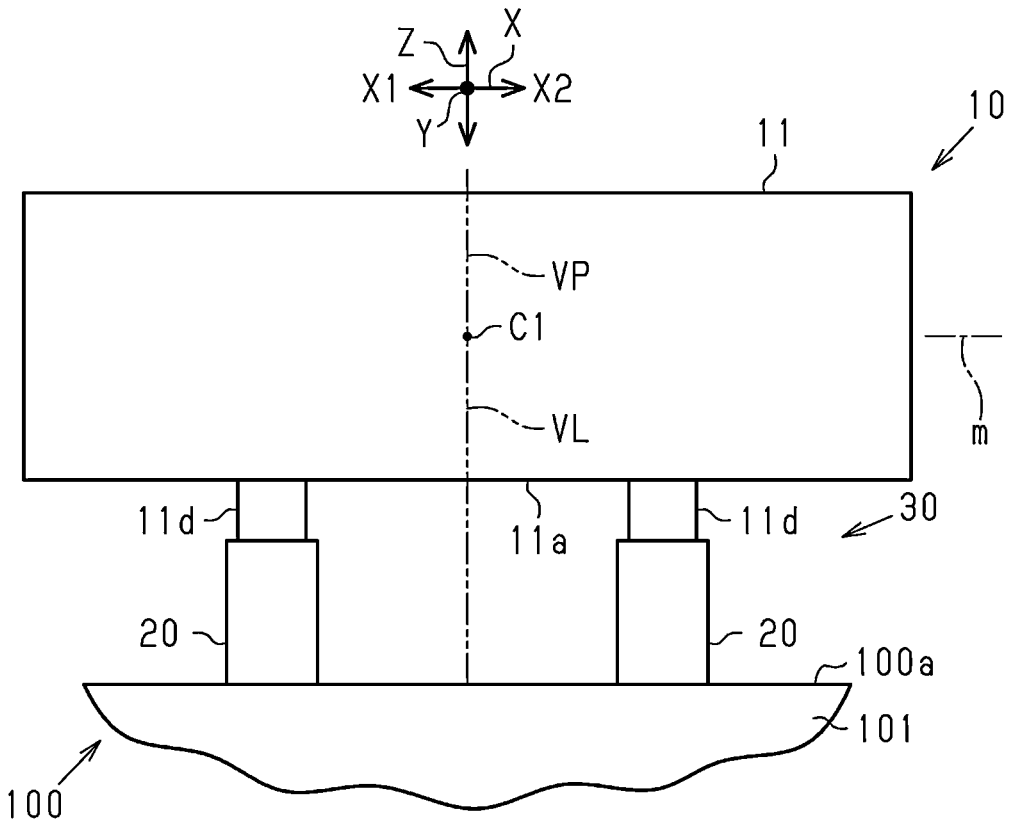
FIG. 1 is a schematic diagram of a mounting structure for a compressor, and a compressor.

As shown in FIG. 1, the compressor 10 includes a housing 11. The housing 11 is, for example, cylindrical. The housing 11 is made of metal. The housing 11 is made of, for example, aluminum. The direction in which an axis m of the housing 11 extends is referred to as an axial direction X. The housing 11 may include multiple housing components separable in the axial direction X.

Figure 2:
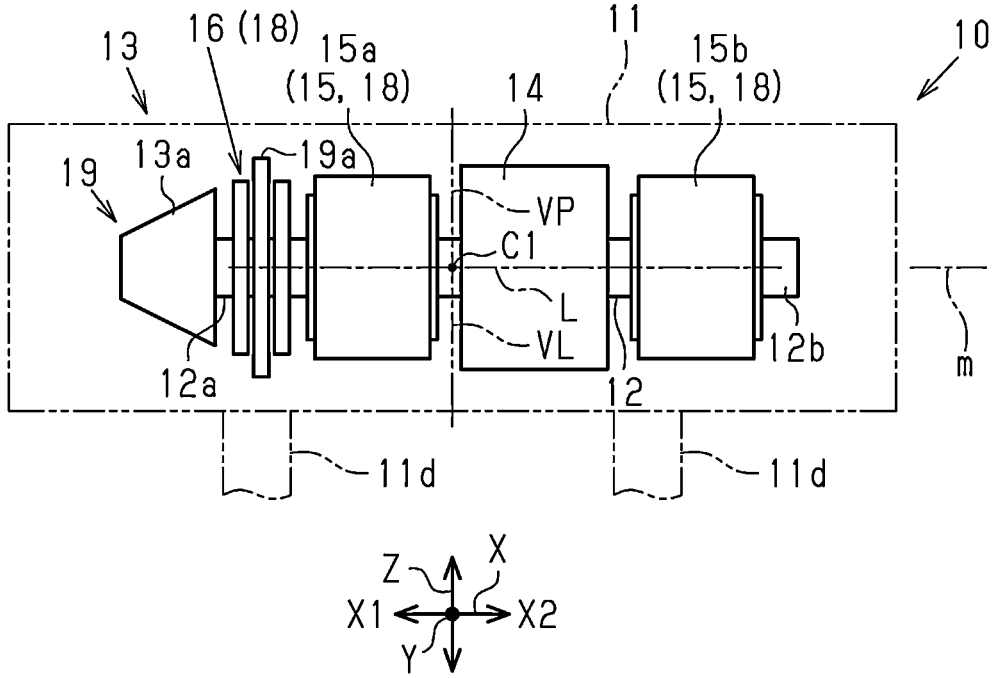
FIG. 2 is a schematic diagram of the compressor shown in FIG. 1.

As shown in FIG. 2, the compressor 10 includes a rotating body 19 and bearings 18. The rotating body 19 includes a rotary shaft 12 and a compression mechanism 13. The compression mechanism 13 includes a compressing portion 13*a*. The bearings 18 include one or more radial bearings 15 and a thrust bearing 16. That is, the compressor 10 includes one or more radial bearings 15 and one thrust bearing 16. The housing 11 accommodates the rotating body 19, the one or more radial bearings 15, and the thrust bearing 16.

Figure 3:
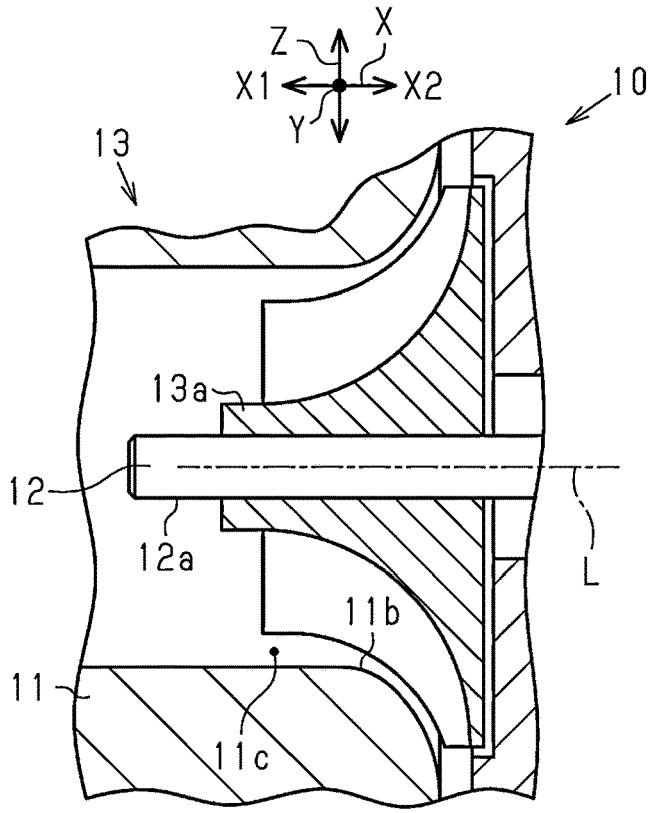
FIG. 3 is a cross-sectional view illustrating a part of the compressor shown in FIG. 2.

As shown in FIG. 3, the housing 11 includes a shroud surface 11*b*. The shroud surface 11*b* has the shape of a truncated cone. The compressing portion 13*a* is located in the space surrounded by the shroud surface 11*b*. That is, the housing 11 accommodates the compressing portion 13*a*.

As shown in FIG. 2, the rotary shaft 12 extends in the same direction as the axis m of the housing 11. That is, the axial direction X corresponds to the axial direction of the rotary shaft 12. A rotation axis L, which is the axis of the rotary shaft 12, extends in the axial direction X. The rotary shaft 12, for example, has a columnar shape. In the axial direction X, one end of the rotary shaft 12 is defined as a first end 12*a*, and the other end of the rotary shaft 12 is defined as a second end 12*b*. The second end 12*b* is an end of the rotary shaft 12 that is on a side opposite to the first end 12*a*. In the axial direction X, a side on which the first end 12*a* is located with respect to an arbitrary reference position between the first end 12*a* and the second end 12*b* is referred to as a first side X1, and a side on which the second end 12*b* is located with respect to the reference position is referred to as a second side X2.

As shown in FIGS. 2 and 3, the compression mechanism 13 is located at least at one end of the rotary shaft 12 in the axial direction X. In the present embodiment, the compression mechanism 13 is provided at the first end 12*a* of the rotary shaft 12 and is not provided at the second end 12*b* of the rotary shaft 12. The compressing portion 13*a* is, for example, an impeller. That is, the compression mechanism 13 includes an impeller. The compressing portion 13*a* has the shape of a truncated cone. The compressing portion 13*a* is surrounded by the shroud surface 11*b* of the housing 11. The compressing portion 13*a* is separated from the shroud surface 11*b*. Accordingly, a tip clearance 11*c* is formed between the compressing portion 13*a* and the shroud surface 11*b*. When the rotary shaft 12 rotates, the compressing portion 13*a* rotates integrally with the rotary shaft 12.

As shown in FIG. 2, the compressor 10 includes an electric motor 14. The electric motor 14 is attached to the rotary shaft 12. The electric motor 14 is driven by power supplied from an inverter (not shown). When the electric motor 14 is driven, the rotary shaft 12 rotates.

The one or more radial bearings 15 rotatably support the rotary shaft 12 in the radial direction. In the present embodiment, the bearings 18 include two radial bearings 15. The two radial bearings 15 include a first radial bearing 15*a* and a second radial bearing 15*b*. The first radial bearing 15*a* supports a portion of the rotary shaft 12 between the first end 12*a* and the electric motor 14. The second radial bearing 15*b* supports a portion of the rotary shaft 12 between the electric motor 14 and the second end 12*b*. In the present embodiment, a center of gravity C1 of the compressor 10 is located between the two radial bearings 15 in the axial direction X. The two radial bearings 15 are fixed to the housing 11. The two radial bearings 15 support the rotary shaft 12 so that the rotary shaft 12 is rotatable relative to the housing 11.

The rotating body 19 includes a support portion 19*a*. The support portion 19*a* protrudes in the radial direction from the outer circumferential surface of the rotary shaft 12. The support portion 19*a* has the shape of a disc. The support portion 19*a* rotates integrally with the rotary shaft 12.

In the present embodiment, the bearings 18 include a single thrust bearing 16. The thrust bearing 16 includes bearing bodies that are arranged to form a pair with the support portion 19*a* in between in the axial direction X. The thrust bearing 16 rotatably supports the support portion 19*a* in the thrust direction. Accordingly, the thrust bearing 16 rotatably supports the rotary shaft 12 in the thrust direction. The thrust direction is the axial direction X of the rotary shaft 12. The thrust bearing 16 supports the rotary shaft 12 so that the rotary shaft 12 is rotatable relative to the housing 11.

The radial bearings 15 and the thrust bearing 16 are gas bearings. The bearings 18, which are gas bearings, are in contact with the rotary shaft 12 until the rotation speed of the rotary shaft 12 reaches a specific rotation speed. When the rotation speed of the rotary shaft 12 reaches the specific rotation speed, air drawn in by the rotation of the rotary shaft 12 forms an air film is formed between the rotary shaft 12 and each bearing 18. The dynamic pressure of the air film formed between the rotary shaft 12 and each bearing 18 levitates the rotary shaft 12. Thus, when the rotation speed of the rotary shaft 12 reaches the specific rotation speed, the bearings 18 support the rotary shaft 12 with the air film without contacting the rotary shaft 12. The use of gas bearings as the bearings 18 limits contact between the rotary shaft 12 and the housing 11.

The compression mechanism 13 rotates with the rotary shaft 12 so as to compress a fluid. In the present embodiment, the fluid is a refrigerant. As the electric motor 14 is driven, the compression mechanism 13 compresses refrigerant that is drawn into the housing 11.

As shown in FIG. 1, the compressor 10 includes projecting portions 11*d*. The projecting portions 11*d* project from an outer surface 11*a* of the housing 11. The projecting portions 11*d* are integrated with the housing 11. The projecting portions 11*d* are thus made of the same metal as the housing 11. The projecting portions 11*d* extend in the same direction from the outer surface 11*a* of the housing 11. The projecting portions 11*d* are, for example, columnar and extend from the outer surface 11*a* of the housing 11 toward a mounting surface 100*a*. The compressor 10 of the present embodiment includes two projecting portions 11*d*. The two projecting portions 11*d* are spaced apart from each other in the axial direction X.

As shown in FIG. 2, one of the two projecting portions 11*d* is provided on the first side X1 with respect to the first radial bearing 15*a* in the axial direction X. The other one of the two projecting portions 11*d* is provided on the second side X2 with respect to the electric motor 14 in the axial direction X. Both of the two projecting portions 11*d* may be located on the second side X2 with respect to the compressing portion 13*a* in the axial direction X.

The center of gravity C1 of the compressor 10 is, for example, located on the rotary shaft 12. An imaginary line extending from the center of gravity C1 of the compressor 10 in one direction that is orthogonal to the axial direction X of the rotary shaft 12 is defined as an imaginary line VL. A plane that includes the center of gravity C1 of the compressor 10 and is orthogonal to the axial direction X of the rotary shaft 12 is defined as an imaginary plane VP. The imaginary line VL extends on the imaginary plane VP.

A direction that is orthogonal to the axial direction X is also referred to as a first orthogonal direction Y. A direction orthogonal to the axial direction X and the first orthogonal direction Y is also referred to as a second orthogonal direction Z. The second orthogonal direction Z is a direction in which the imaginary line VL extends. The first orthogonal direction Y is a direction in which an imaginary straight line orthogonal to the rotation axis L of the rotary shaft 12 and the imaginary line VL extends.

The imaginary plane VP is located between the two projecting portions 11*d* in the axial direction X. At least one of the projecting portions 11*d* is located on the first side X1 with respect to the imaginary plane VP, and at least one of the projecting portions 11*d* is located on the second side X2 with respect to the imaginary plane VP. In the present embodiment, one projecting portion 11*d* is located on the first side X1 with respect to the imaginary plane VP, and one projecting portion 11*d* is located on the second side X2 with respect to the imaginary plane VP.

Mounting Structure for Compressor

As shown in FIG. 1, the compressor 10 is mounted on the mounting surface 100*a* of a vehicle 100 by a mounting structure 30. In other words, the mounting structure 30 is used to mount the compressor 10 on the mounting surface 100*a* of the vehicle 100. The mounting surface 100*a* is, for example, part of a frame 101 of the vehicle 100. A combination of the compressor 10 and the mounting structure 30 is referred to as a compressor unit or compressor system.

The mounting structure 30 includes mounting feet 20. The mounting feet 20 are fixed to the respective projecting portions 11*d*. The mounting feet 20 are thus fixed to the housing 11. The mounting structure 30 of the present embodiment includes two mounting feet 20. The two mounting feet 20 are spaced apart from each other in the axial direction X.

The mounting feet 20 are made from elastic members. The elastic members are made from, for example, rubber members or urethane members, which are elastically deformable plastic members. The mounting feet 20 are attached to, for example, distal ends of the projecting portions 11*d*, that is, the ends of the projecting portions 11*d* opposite to the outer surface 11*a* of the housing 11. The mounting feet 20 are, for example, columnar and extend from the distal ends of the projecting portions 11*d* toward the mounting surface 100*a*. The mounting feet 20 are attached to the mounting surface 100*a* with fastening members such as bolts. This fixes the mounting feet 20 to the mounting surface 100*a*. In the present embodiment, the mounting surface 100*a*, to which the mounting feet 20 are attached, is a single flat surface.

As shown in FIGS. 1 and 2, one of the two mounting feet 20 is fixed to one of the two projecting portions 11*d*, and the other one of the two mounting feet 20 is fixed to the other one of the two projecting portions 11*d*. Thus, one of the two mounting feet 20 is connected to the housing 11 on the first side X1 with respect to the first radial bearing 15*a* in the axial direction X. The other one of the two mounting feet 20 is connected to the housing 11 on the second side X2 with respect to the electric motor 14 in the axial direction X. The imaginary plane VP is located between the two mounting feet 20 in the axial direction X. One of the two mounting feet 20 is located on the first side X1 with respect to the imaginary plane VP, and the other one of the two mounting feet 20 is located on the second side X2 with respect to the imaginary plane VP.

Magnitude Relationship Among of Resonance Frequencies

The resonance frequency of each of the mounting feet 20 is referred to as a mounting foot resonance frequency F1. The resonance frequency of each of the radial bearings 15 is referred to as a radial bearing resonance frequency F2. The resonance frequency of the thrust bearing 16 is referred to as a thrust bearing resonance frequency F3. The mounting feet 20 provided in the mounting structure 30 may have the same mounting foot resonance frequency F1 or different mounting foot resonance frequencies F1.

The above-described mounting foot resonance frequency F1 is one of multiple types of mounting foot resonance frequency F1. The multiple types of mounting foot resonance frequency F1 include a mounting foot resonance frequency F1 in a translational direction and a mounting foot resonance frequency F1 in a rotational direction. The mounting foot resonance frequency F1 in the translational direction includes three types, which are a mounting foot resonance frequency F1 in a translational direction along an imaginary axis extending in the axial direction X, a mounting foot resonance frequency F1 in a translational direction along an imaginary axis extending in the first orthogonal direction Y, and a mounting foot resonance frequency F1 in a translational direction along an imaginary axis extending in the second orthogonal direction Z. The mounting foot resonance frequency F1 in the rotational direction includes three types, which are a mounting foot resonance frequency F1 in a rotational direction about an imaginary axis extending in the axial direction X, a mounting foot resonance frequency F1 in a rotational direction about an imaginary axis extending in the first orthogonal direction Y, and a mounting foot resonance frequency F1 in a rotational direction about an imaginary axis extending in the second orthogonal direction Z. In these six types of the mounting foot resonance frequency F1, the mounting foot resonance frequency F1 in a translational direction along an imaginary axis extending in the first orthogonal direction Y will be described below as an example.

In the compressor 10, the number of radial bearing resonance frequencies F2 is equal to the number of the radial bearings 15 provided in the compressor 10. Thus, in the compressor 10 of the present embodiment, two resonance frequencies are defined as the radial bearing resonance frequencies F2.

In the compressor 10, the thrust bearing resonance frequency F3 is set to be the same number as the number of thrust bearing 16 in the compressor 10. Thus, in the compressor 10 of the present embodiment, one resonance frequency is defined as the thrust bearing resonance frequency F3.

The weight of the housing 11 is referred to as a housing weight M1. The weight of the rotating body 19 is referred to as a rotating body weight M2. The total stiffness of the mounting feet 20 is referred to as a mounting foot stiffness K1. The total stiffness of the radial bearings 15 is referred to as a radial bearing stiffness K2. The total stiffness of the thrust bearing 16 is referred to as a thrust bearing stiffness K3. The mounting foot stiffness K1, the radial bearing stiffness K2, and the thrust bearing stiffness K3 are values expressed in units of N/m. The mounting foot stiffness K1, the radial bearing stiffness K2, and the thrust bearing stiffness K3 are stiffnesses in the direction in which the imaginary line VL extends. The direction in which the imaginary line VL extends is the direction in which vibration is applied from the vehicle 100 to the compressor 10 via the mounting feet 20.

The stiffness of each mounting foot 20 is a value unique to the mounting foot 20, and is determined by the shape and/or material of the mounting foot 20. The stiffnesses of the two mounting feet 20 in the mounting structure 30 may be the same or different from each other. The total stiffness of the mounting feet 20 in the radial direction is equal to the total stiffness in the thrust direction.

The stiffness of each radial bearing 15 is a value unique to the radial bearing 15, which is determined by the shape and/or material of the radial bearing 15. The stiffnesses of the two radial bearings 15 in the compressor 10 may be the same or different from each other. The stiffness of the thrust bearing 16 is a value unique to the thrust bearing 16, which is determined by the shape and/or material of the thrust bearing 16.

The mounting foot resonance frequency F1 is represented by the following Expression (1).

$$F1 = \frac{1}{2\pi}\sqrt{K1/M1} \quad (1)$$

The radial bearing resonance frequency F2 is represented by the following Expression (2).

$$F2 = \frac{1}{2\pi}\sqrt{K2/M2} \quad (2)$$

The thrust bearing resonance frequency F3 is represented by the following Expression (3).

$$F3 = \frac{1}{2\pi}\sqrt{K3/M2} \quad (3)$$

The mounting foot resonance frequency F1 is lower than the radial bearing resonance frequency F2 and lower than the thrust bearing resonance frequency F3. Thus, the following Expressions (4) and (5) are established from the above Expressions (1), (2), and (3).

$$\frac{1}{2\pi}\sqrt{K1/M1} < \frac{1}{2\pi}\sqrt{K2/M2} \quad (4)$$

$$\frac{1}{2\pi}\sqrt{K1/M1} < \frac{1}{2\pi}\sqrt{K3/M2} \quad (5)$$

The mounting foot resonance frequency F1 that satisfies the above Expressions (4) and (5) is the mounting foot resonance frequency F1 in a translational direction along an imaginary axis extending in the first orthogonal direction Y. At least one of the six types of the mounting foot resonance frequency F1 may be lower than the radial bearing resonance frequency F2 and lower than the thrust bearing resonance frequency F3. The six types of the mounting foot resonance frequency F1 include, in addition to the mounting foot resonance frequency F1 in the translational direction along an imaginary axis extending in the first orthogonal direction Y, the mounting foot resonance frequency F1 in a translational direction along an imaginary axis extending in the axial direction X, the mounting foot resonance frequency F1 in a translational direction along an imaginary axis extending in the second orthogonal direction Z, the mounting foot resonance frequency F1 in a rotational direction about an imaginary axis extending in the axial direction X, the mounting foot resonance frequency F1 in a rotational direction about an imaginary axis extending in the first orthogonal direction Y, and the mounting foot resonance frequency F1 in a rotational direction about an imaginary axis extending in the second orthogonal direction Z.

Comparison of Data

Figure 4:
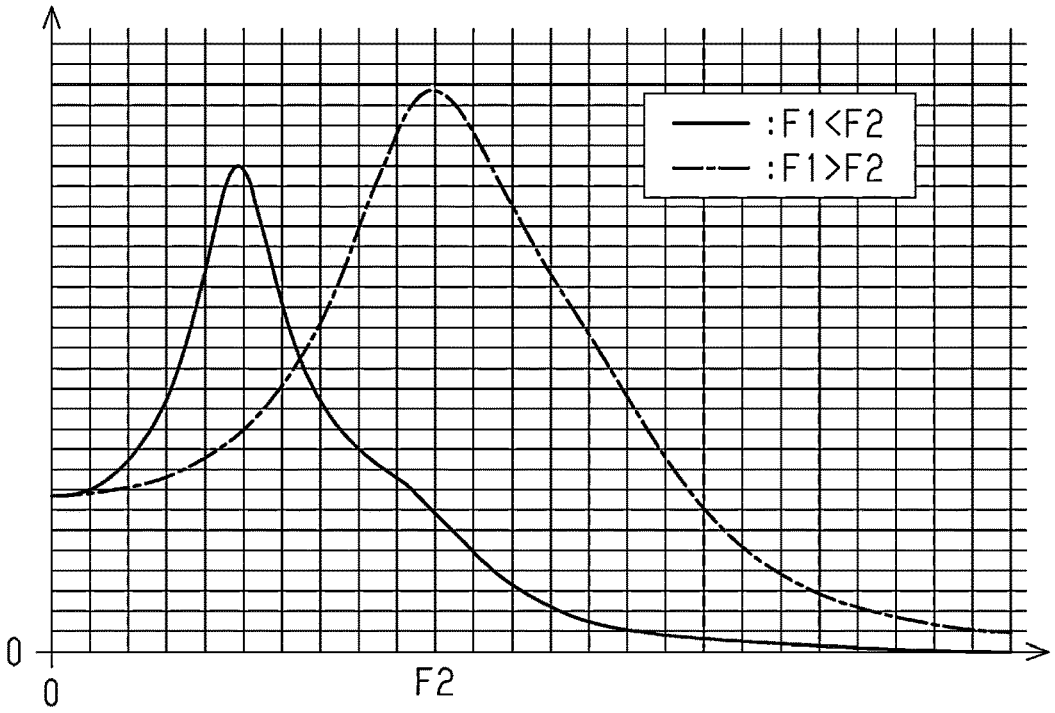
FIG. 4 is a graph showing a relationship between an excitation frequency and an amount of deflection of a rotating body.

Experimental results were obtained regarding the relationship between the excitation frequency and the amount of deflection of the rotating body 19 for a mounting structure 30 of a first example and a mounting structure 30 of a first comparative example. The results are shown in FIG. 4. In FIG. 4, the horizontal axis represents the excitation frequency, and the vertical axis represents the amount of deflection of the rotating body 19. The excitation frequency is the frequency of vibration applied to the compressor 10 from outside. The amount of deflection of the rotating body 19 corresponds to the amount of deflection of the compressing portion 13*a*. The amount of deflection of the compressing portion 13*a* is, for example, the amount of displacement of the compressing portion 13*a* in the radial direction of the rotary shaft 12. In FIG. 4, the data trace for the first example is indicated by a solid line. In FIG. 4, the data trace for the first comparative example is indicated by a long-dash short-dash line.

As in the embodiment, the mounting foot resonance frequency F1 of the mounting structure 30 of the first example was lower than the radial bearing resonance frequency F2. Unlike the embodiment, the mounting foot resonance frequency F1 of the mounting structure 30 of the first comparative example was higher than the radial bearing resonance frequency F2.

As shown in FIG. 4, the excitation frequency at which the peak of the amount of deflection of the rotating body 19 occurred in the first example was lower than the excitation frequency at which the peak of the amount of deflection of the rotating body 19 occurred in the first comparative example. In the first comparative example, the peak of the amount of deflection of the rotating body 19 occurred when the excitation frequency was near the radial bearing resonance frequency F2. In contrast, in the first example, the peak of the amount of deflection of the rotating body 19 occurred when the excitation frequency was lower than the radial bearing resonance frequency F2. Thus, when the excitation frequency was equal to the radial bearing resonance frequency F2, the amount of deflection of the rotating body 19 in the first example was smaller than the amount of deflection of the rotating body 19 in the first comparative example.

When the excitation frequency is equal to the radial bearing resonance frequency F2, the radial bearings 15 resonate due to the vibration applied to the compressor 10. This causes the rotating body 19 to vibrate most significantly. Thus, in order to suppress the vibration of the compressing portion 13*a*, it is desirable to reduce the amount of deflection of the rotating body 19 when the excitation frequency is equal to the radial bearing resonance frequency F2. FIG. 4 shows that, as in the mounting structure 30 of the first example, the vibration of the compressing portion 13*a* is suppressed if the mounting foot resonance frequency F1 is lower than the radial bearing resonance frequency F2.

The above-described characteristics of the radial bearing resonance frequency F2 are common to the thrust bearing resonance frequency F3. Specifically, the mounting foot resonance frequency F1 of the mounting structure 30 of the second example was lower than the thrust bearing resonance frequency F3. The mounting foot resonance frequency F1 of the mounting structure 30 of a second comparative example was higher than the thrust bearing resonance frequency F3. In the second comparative example, the peak of the amount of deflection of the rotating body 19 occurred when the excitation frequency was near the thrust bearing resonance frequency F3. In contrast, in the second example, the peak of the amount of deflection of the rotating body 19 occurred when the excitation frequency was lower than the thrust bearing resonance frequency F3. Thus, when the excitation frequency was equal to any of the thrust bearing resonance frequency F3, the amount of deflection of the rotating body 19 in the second example was smaller than the amount of deflection of the rotating body 19 in the second comparative example.

When the excitation frequency is equal to the thrust bearing resonance frequency F3, the thrust bearing 16 resonates due to the vibration applied to the compressor 10. This causes the rotating body 19 to vibrate significantly. Thus, in order to suppress the vibration of the compressing portion 13*a*, it is desirable to reduce the amount of deflection of the rotating body 19 when the excitation frequency is equal to the thrust bearing resonance frequency F3. Therefore, as in the mounting structure 30 of the second example, the vibration of the compressing portion 13*a* is suppressed if the mounting foot resonance frequency F1 is lower than the thrust bearing resonance frequency F3.

Operation and Advantages of Embodiment

An operation and advantages of the embodiment will now be described.

(1) The mounting foot resonance frequency F1 is lower than the radial bearing resonance frequency F2 and lower than the thrust bearing resonance frequency F3. Therefore, at the time of resonance of the radial bearings 15, which is the time when the rotating body 19 vibrates most significantly, the amount of deflection of the rotating body 19 is reduced. This suppresses the vibration of the compression mechanism 13, which occurs due to the vibration of the vehicle 100.

(2) The compression mechanism 13 is provided at the first end 12*a* of the rotary shaft 12 and is not provided at the second end 12*b*. Thus, as compared with a case in which the compression mechanism 13 is provided at either end of the rotary shaft 12, the amount of deflection of the rotating body 19 is likely to increase due to the offset of the center of gravity of rotating body 19. Even in cases in which the vibration of rotating body 19 is of greater concern, the use of the mounting structure 30 of the present embodiment suppresses the vibration of compression mechanism 13 that occurs in conjunction with the vibration of vehicle 100.

(3) The compression mechanism 13 includes the compressing portion 13*a*, which is an impeller. Since compressing portion 13*a* does not contact the housing 11, the amount of deflection of the compressing portion 13*a* presents an issue. Specifically, due to the small dimensions of the tip clearance 11*c*, formed between the shroud surface 11*b* of the housing 11 and the compressing portion 13*a*, the compressing portion 13*a* is prone to colliding with the housing 11 when the compression mechanism 13 experiences significant vibration. However, by suppressing the vibration of the compression mechanism 13 that occur in conjunction with the vibration of vehicle 100, collisions between the compressing portion 13*a* and the housing 11 are prevented.

(4) The compressor 10 is mounted on the mounting surface 100*a* of a vehicle 100 by the mounting structure 30. The fluid compressed by the compression mechanism 13 is refrigerant. Since refrigerant has a higher load density than air, the rotary shaft 12 is less likely to collide with the radial bearings 15 or the thrust bearing 16 when vibration acts on the housing 11, as compared with a case in which air is used as the fluid compressed by the compression mechanism 13. On the other hand, the use of the mounting structure 30 suppresses the vibration of the compression mechanism 13 that can occur when the rotary shaft 12 does not collide with the radial bearings 15 or the thrust bearing 16 when the vibration acts on the housing 11.

(5) The radial bearings 15 and the thrust bearing 16 are gas bearings. The stiffness of a gas bearing tends to be lower than the stiffness of a rolling-element bearing. Therefore, when gas bearings are used as the radial bearings 15 and the thrust bearing 16, the radial bearing resonance frequency F2 and the thrust bearing resonance frequency F3 are lower than those when rolling-element bearings are used as the radial bearings 15 and the thrust bearing 16. Thus, even when the radial bearing resonance frequency F2 and the thrust bearing resonance frequency F3 tend to be close to the mounting foot resonance frequency F1, the use of the mounting structure 30 of the present embodiment suppresses the vibration of the compression mechanism 13 caused by the vibration of the vehicle 100. Since the radial bearings 15 and the thrust bearing 16, which are gas bearings, are not in contact with the rotary shaft 12, the amount of deflection of the compression mechanism 13 presents an issue. The use of the mounting structure 30 suppresses such vibration of the compression mechanism 13.

(6) The mounting feet 20 are made from elastic members. Therefore, as compared to a case in which the mounting feet 20 are made from metal members, the vibration damping effect of the mounting feet 20 is enhanced, allowing for suppression of the vibration of the compressor 10 when the vehicle 100 vibrates. This further suppresses the vibration of the compression mechanism 13 that occurs in conjunction with the vibration of vehicle 100. Additionally, the use of the mounting feet 20 made from elastic members reduces the mounting stiffness of the mounting feet 20 with the housing 11 and the mounting surface 100*a* as compared to a case in which the mounting feet 20 are made from metal members. This, in turn, reduces the mounting foot stiffness K1, allowing the mounting foot resonance frequency F1 to be lower than both the radial bearing resonance frequency F2 and the thrust bearing resonance frequency F3.

(7) The compressor 10 is mounted on the vehicle 100. Therefore, since the vibration of the vehicle 100 is transmitted to the compressor 10, the vibration applied to the compressor 10 from the outside of the compressor 10 is large, for example, as compared with a case in which the compressor 10 is provided at a place other than the vehicle 100. By employing the mounting structure 30 of the present embodiment for the compressor 10, which is subjected to these significant external vibrations, it is possible to suppress the vibrations of the compression mechanism 13.

Modifications

The above-described embodiment may be modified as follows. The above-described embodiment and the following modifications can be combined if the combined modifications remain technically consistent with each other.

The number of the mounting feet 20 in the mounting structure 30 may be one or more than two. The number of the projecting portions 11*d* in the housing 11 may be changed in accordance with the number of the mounting feet 20.

The mounting feet 20 may be directly fixed to the outer surface 11*a* of the housing 11 without the projecting portions 11*d*. In this case, the projecting portions 11*d* may be omitted from the compressor 10.

When the mounting structure 30 includes multiple mounting feet 20, the mounting surface 100*a* may include multiple surfaces to which the respective mounting feet 20 are fixed. A mounting surface 100*a* to which at least one of the mounting feet 20 is fixed and a mounting surface 100*a* to which at least another one of the mounting feet 20 is fixed may extend in different directions. In this case, the axial directions of the mounting feet 20 extending from the housing 11 toward the mounting surfaces 100*a* may be different from each other.

When the mounting structure 30 includes multiple mounting feet 20, two or more mounting feet 20 may be located on the first side X1 with respect to the imaginary plane VP, and two or more mounting feet 20 may be located on the second side X2 with respect to the imaginary plane VP. All of the mounting feet 20 of the mounting structure 30 may be located on the first side X1 with respect to the imaginary plane VP or on the second side X2 with respect to the imaginary plane VP.

The compressor 10 may include one radial bearing 15 or more than two radial bearings 15. The compressor 10 may include two or more thrust bearings 16.

The compression mechanism 13 may be located either end of the rotary shaft 12 in the axial direction X.

The compression mechanism 13 does not necessarily need to include an impeller as the compressing portion 13*a*. For example, the compressor 10 may be of a piston type or a scroll type.

In the above-described embodiment, the compressor 10 is used in a vehicle air conditioner. However, the compressor 10 may be used in other apparatuses. The compressor 10 may be any compressor that compresses refrigerant, and the use of the compressor 10 can be appropriately changed.

The compression mechanism 13 may compress a fluid that is not a refrigerant. For example, the compression mechanism 13 may compress air.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A mounting structure for mounting a compressor on a mounting surface of a vehicle, wherein the compressor includes:

a rotating body that includes a rotary shaft and a compression mechanism, the compression mechanism being provided at least at one end of the rotary shaft in an axial direction and configured to rotate with the rotary shaft so as to compress a fluid;

a radial bearing that rotatably supports the rotary shaft in a radial direction;

a thrust bearing that rotatably supports the rotary shaft in a thrust direction; and a housing that accommodates the rotating body, the radial bearing, and the thrust bearing, the radial bearing and the thrust bearing are gas bearings, the mounting structure comprises a mounting foot that is made from an elastic member and fixed to the housing and the mounting surface, and a resonance frequency of the mounting foot is lower than a resonance frequency of the radial bearing and lower than a resonance frequency of the thrust bearing.

2. The mounting structure according to claim 1, wherein the compression mechanism is provided at one end of the rotary shaft in the axial direction and is not provided at the other end of the rotary shaft.

3. The mounting structure according to claim 1, wherein the compression mechanism includes an impeller.

4. A compressor that is mounted on the mounting surface by the mounting structure according to claim 1, wherein the fluid is a refrigerant.

* * * * *